US005445749A

United States Patent [19]

Hong

[11] Patent Number: 5,445,749

[45] Date of Patent: Aug. 29, 1995

[54] THIOCARBAMATES FOR METAL/CERAMIC LUBRICATION

[75] Inventor: Hyun-Soo Hong, Moreland Hills, Ohio

[73] Assignee: The Lubrizol Corporation, Wickliffe, Ohio

[21] Appl. No.: 294,295

[22] Filed: Aug. 23, 1994

Related U.S. Application Data

[63] Continuation-in-part of Ser. No. 12,076, Feb. 1, 1993, abandoned.

[51] Int. Cl.[6] ..... C10M 135/18

[52] U.S. Cl. ..... 252/33.6; 252/47.5; 252/49.3; 252/68; 44/367; 44/387

[58] Field of Search ..... 252/33.6, 47.5, 49.3, 252/68; 44/367, 368

[56] References Cited

U.S. PATENT DOCUMENTS

| | | | |
|---|---|---|---|
| 2,794,781 | 6/1957 | Diamond et al. | 252/33.6 |
| 2,805,996 | 9/1957 | Deger | 252/33.6 |
| 3,356,702 | 12/1967 | Farmer et al. | 260/429 |
| 3,419,589 | 12/1968 | Larson et al. | 260/429 |
| 3,462,367 | 8/1969 | Booker | 252/33.2 |
| 3,707,498 | 12/1972 | Milsom | 252/33.6 |
| 3,840,463 | 10/1974 | Froeschmann et al. | 252/42.7 |
| 3,988,249 | 10/1976 | Geucarelli et al. | 252/33.6 |
| 4,098,705 | 7/1978 | Sakurai et al. | 252/33.6 |
| 4,178,251 | 12/1979 | Papay et al. | 252/33.6 |
| 4,395,343 | 7/1983 | de Vries et al. | 252/32.7 |
| 4,479,883 | 10/1984 | Shaub et al. | 252/33.6 |
| 4,588,829 | 5/1986 | Pan et al. | 556/38 |
| 4,681,958 | 7/1987 | Halbert et al. | 556/42 |
| 4,832,867 | 5/1989 | Seiki et al. | 252/325 |
| 4,842,753 | 6/1989 | Mori et al. | 252/42.7 |
| 4,846,983 | 7/1989 | Ward | 252/33.6 |
| 4,849,123 | 7/1989 | Tipton et al. | 252/75 |
| 4,978,464 | 12/1990 | Coyle et al. | 252/42.7 |
| 5,055,211 | 10/1991 | Habeeb et al. | 252/42.7 |
| 5,236,610 | 8/1993 | Perez et al. | 252/46.3 |

FOREIGN PATENT DOCUMENTS 2619392 2/1989 France .

OTHER PUBLICATIONS

"Verschleiss und Reibung keramischer Werkstoffe bei Mischrebung", Tribologie & Schmierungstechnik, 28, pp. 282–287, May, 1992.

Gates et al "Effect of Selected Chemical Compounds on the Lubrication of Silicon Nitride" Tribology Transactions, 34 (1991) 417–425.

Yamamoto et al "Friction and Wear Characteristics of Molybdenum Dithiocarbamate and Molybdenum Dithiophosphate: Tribology Transacitons" 32 (1989) 2 251–257.

Rounds "Effect of Detergents on ZDP Antiwear Performance as Measured in Four-Ball Wear Tests": J. Soc. Tribologists and Lubrication Engineers, Lubricating Engineering 45 12 (1989 761–769.

*Primary Examiner*—Jacqueline V. Howard

*Attorney, Agent, or Firm*—David M. Shold; Frederick D. Hunter

[57] ABSTRACT

Hybrid engines containing a metal-ceramic interface can be lubricated with composition comprising a carrier fluid and a molybdenum thiocarbamate. Friction and wear are low even when detergent and dispersant additives are present in the lubricant.

31 Claims, No Drawings

THIOCARBAMATES FOR METAL/CERAMIC LUBRICATION

RELATED APPLICATIONS

This is a continuation-in-part of application Ser. No. 08/012,076 filed on Feb. 1, 1993, now abandonded.

BACKGROUND OF THE INVENTION

The present invention relates to a method for lubricating a ceramic-metal interface, such as may be found in an internal combustion engine.

The increased use of ceramic components in passenger cars, such as ceramic valve train components, requires a lubricant which can be used in hybrid ceramic engines. However, high wear losses of metals in contact with ceramics in the presence of conventional lubricants containing zinc dithiophosphate extreme pressure agents are a concern. It has been reported in *Lub. Eng.*, 45, 1989, p. 761, F. Rounds, that interaction among surface-active additives (detergents and dispersants) in lubricants has a negative effect on the anti-wear performance of zinc dithiophosphate at a low load region in the anti-wear regime. The present invention, therefore, provides an improved method for lubricating such ceramic-metal interfaces.

*Tribology Transactions,* 34 (1991) 417–425 (Preprint No. 90-TC-2C-1, Oct. 8–10, 1990), Gates and Hsu, "Effect of Selected Chemical Compounds on the Lubrication of Silicon Nitride," discloses lubrication of ceramic surfaces with a variety of compounds including organo molybdenum dithiocarbamate and sulfur-molybdenum compounds. Molybdenum-sulfur compounds are reported to only act as friction reducers for silicon nitride unless they also contain phosphorus. When phosphorus is also present, low wear can be obtained in addition to low friction.

*Tribology Transactions* 32 (1989) 2, 251–257, Yamamoto and Gondo, "Friction and Wear Characteristics of Molybdenum Dithiocarbamate and Molybdenum Dithiophosphate," discloses the use of molybdenum dithiocarbamate in a hydrocarbon baseline oil for reducing friction between surfaces of high carbon chromium bearing steel.

U.S. Pat. No. 4,832,867, Seiki et al., May 23, 1989, discloses a lubricating oil composition which comprises lubricating base oil, at least one organophosphorus compound, and at least one organomolybdenum compound selected from the group consisting of molybdenum oxysulfide alkylphosphorodithioates and molybdenum oxysulfide alkyldithiocarbamates. The lubricating composition is reportedly excellent in antiwear properties, anti-seizure properties, and corrosion resistance, and is suitable for gear oils, bearing oils, internal combustion engine oils, automatic transmission fluids, hydraulic fluid, and metal working fluids.

U.S. Pat. No. 4,846,983, Ward, Jr., Jul. 11, 1989, discloses molybdenum or tungsten thiocarbamate additives for functional fluids, e.g., lubricating oils, automatic transmission fluids, and fuel compositions.

SUMMARY OF THE INVENTION

The present invention provides a method for lubricating a metal-ceramic interface, comprising supplying to said interface a composition comprising:

(a) a carrier fluid, and (b) a thiocarbamate compound.

The present invention further provides an internal combustion engine containing a metal-ceramic interface lubricated by the aforementioned method.

DETAILED DESCRIPTION OF THE INVENTION

In the present invention a lubricant composition is supplied to a metal-ceramic interface. Metals include any of the metals which can be used for structural purposes, including ferrous metals, aluminum, magnesium, nickel, titanium, tungsten, vanadium, chromium, copper, palladium, silver, cadmium, tin, platinum, gold, lead, and alloys, blends, and metallic compounds of these metals with each other and with other elements. Particularly preferred are ferrous metals including iron, cast iron, steel, and stainless steel. Most preferred is cast iron, and in particular grades of cast iron which are suitable for use as components in internal combustion engines.

Ceramics can be generally described as inorganic solids prepared by the well-known process of sintering of inorganic powders. Inorganic powders in general can be metallic or non-metallic powders, but as used in the present invention they are normally non-metallic powders. Such powders may also be oxides or non-oxides of metallic or non-metallic elements. The inorganic powders may comprise inorganic compounds of one or more of the following metals or semi-metals: calcium, magnesium, barium, scandium, titanium, vanadium, chromium, manganese, iron, cobalt, nickel, copper, zinc, yttrium, niobium, molybdenum, ruthenium, rhodium, silver, cadmium, lanthanum, actinium, gold, rare earth elements including the lanthanide elements having atomic numbers from 57 to 71, inclusive, the element yttrium, atomic number 39, and silicon. The inorganic compounds include ferrites, titanates, nitrides, carbides, borides, fluorides, sulfides, hydroxides and oxides of the above elements. Specific examples of the oxide powders include, in addition to the oxides of the above-identified metals, compounds such as beryllium oxide, magnesium oxide, calcium oxide, strontium oxide, barium oxide, lanthanum oxide, gallium oxide, indium oxide, selenium oxide, etc. Specific examples of oxides containing more than one metal, generally called double oxides, include perovskite-type oxides such as $NaNbO_3$, $SrZrO_3$, $PbZrO_3$, $SrTiO_3$, $BaZrO_3$, BaTiO3; spinel-type oxides such as $MgAl_2O_4$, $ZnAl_2O_4$, $CoAl_2O_4$, $NiAl_2O_4$, $NiCr_2O_4$, $FeCr_2O_4$, $MgFe_2O_4$, $ZnFe_2O_4$, etc.; illmenite-types oxides such as $MgTiO_3$, $MnTiO_3$, $FeTiO_3$, $CoTiO_3$, $ZnTiO_3$, $LiTaO_3$, etc.; and garnet-type oxides such as $Gd_3Ga_5O_{12}$ and rare earth-iron garnet represented by $Y_3Fe_5O_{12}$.

An example of non-oxide powders include carbides, nitrides, borides and sulfides of the elements described above. Specific examples of the carbides include SiC, TiC, WC, TaC, HfC, ZrC, AlC; examples of nitrides include $Si_3N_4$, AlN, BN and $Ti_3N_4$; and borides include $TiB_2$, $ZrB_2$ and $LaB_6$.

The inorganic powders may also be a clay. Examples of clays include kaolinite, nacrite, dickite, montmorillonite, nontronite, spaponite, hectorite, etc.

In one embodiment, the inorganic powder is silicon nitride, silicon carbide, zirconia, alumina, aluminum nitride, barium ferrite, barium-strontium ferrite or copper oxide. In another embodiment, the inorganic powder is alumina or clay. Preferably the ceramic is prepared from alumina, aluminum nitride, silicon carbide, barium ferrite copper oxide, or most preferably silicon nitride ($Si_3N_4$).

Organic binders may be included in the compositions of inorganic powder to facilitate the production of so-called "green bodies" as an intermediate step to preparation of the final ceramic material. Such green bodies can be produced by extrusion or injection molding, press molding or slip casting or other methods. The amount of binder included in the compositions is an amount which provides the desired properties for the green and sintered shapes. Generally, the compositions will contain about 5% by weight of the binder based on the weight of the inorganic powder although larger amounts, such as to about 30% by weight, can be utilized in some applications. The binder may be present in amounts greater than 0.5% by weight of the inorganic powder.

A variety of binders have been suggested and utilized in the prior art and can be utilized in preparing ceramics. Examples of these binders include starch, cellulose derivatives, polyvinyl alcohols, polyvinylbutyral, etc. Examples of synthetic resin binders include thermoplastic materials such as polystyrene, polyethylene, polypropylene and mixtures thereof. Other binders include vegetable oils, petroleum jelly and various wax-type binders which may be hydrocarbon waxes or oxygen-containing hydrocarbon waxes.

Sintering aids may also be used to facilitate formation of ceramic materials. Sintering aids can be organic or inorganic materials which improve properties of the final sintered product. Examples of inorganic materials include the hydroxides, oxides or carbonates of alkali metals, alkaline earth metals, and the transition metals including, in particular, the rare earth elements. Specific examples of inorganic sintering aids include calcium oxide, magnesium oxide, calcium carbonate, magnesium carbonate, zinc oxide, zinc carbonate, yttrium oxide, yttrium carbonate, zirconium oxide, zirconium carbonate, lanthanum oxide, neodymium oxide, samarium oxide, etc. Other traditional additives and components for formation of ceramics can also be used.

The formation of ceramics generally includes as a first step the dispersion of the inorganic powder in a liquid disperse medium. The amount of liquid disperse medium utilized may vary over a wide range although it is generally desirable to prepare compositions containing a maximum amount of the inorganic powder and a minimum amount of the disperse medium. The amount of liquid disperse medium utilized in any particular combination can be readily determined by one skilled in the art will depend upon the nature of the inorganic powder, the type and amount of dispersant, and any other components present in the composition. The amount of liquid dispersed medium present is usually from as low as 1–2%, generally about 5%, preferably about 10%, more preferably about 15%, to about 40%., preferably about 35%, more preferably about 30% by weight based on the amount of inorganic powder.

The liquid dispersing medium may be oxygenated or hydrocarbon in nature and is preferably volatile, to facilitate its removal. Oxygenated solvents include alcohols, esters, ketones and water as well as ethoxylated versions of the same. Combinations of these materials are also useful. Alkyl, cycloalkyl and aryl hydrocarbons, as well as petroleum fractions may also be used as liquid media. Included within these types are benzene and alkylated benzenes, cycloalkanes and alkylated cycloalkanes, cycloalkenes and alkylated cycloalkenes such as found in the naphthene-based petroleum fraction, and the alkanes such as found in the paraffin-based petroleum fractions.

Formation of a final ceramic part is generally accomplished by blending the above ingredients and shaping them in a mold, a still water press, or sheet mold. Alternatively, the blended mixture can be extrusion- or injection molded to form a green body, or the mixture can be prepared by casting the mixture on a tape. The green body may also be prepared by spray-drying, rotary evaporation, etc. Following the formation of the mixture into the desired shape, the shaped mass is subjected to elevated temperature treatment (sintering). At this time the inorganic powders are sintered resulting in the formation of a shape having the desired properties including suitable densities. For ceramic processes, the sintering generally occurs from about 600° C., preferably about 700° C. up to about 1700° C.

The process of the present invention comprises lubricating a metal-ceramic interface by supplying a select lubricant composition to the interface. The lubricant used comprises a carrier fluid and a thiocarbamate compound.

The carrier fluid is most commonly an oil of lubricating viscosity or a liquid fuel. Oils of lubricating viscosity include natural and synthetic lubricating oils and mixtures thereof. Natural oils include animal oils, vegetable oils, mineral lubricating oils of paraffinic, naphthenic, or mixed types, solvent or acid treated mineral oils, and oils derived from coal or shale. Synthetic lubricating oils include hydrocarbon oils, halo-substituted hydrocarbon oils, alkylene oxide polymers (including those made by polymerization of ethylene oxide or propylene oxide), esters of dicarboxylic acids and a variety of alcohols including polyols, esters of monocarboxylic acids and polyols, esters of phosphorus-containing acids, polymeric tetrahydrofurans, and silicon based oils (including siloxane oils and silicate oils). Included are unrefined, refined, and rerefined oils. Specific examples of the oils of lubricating viscosity are described in U.S. Pat. No. 4,326,972.

The lubricating oil in the invention will normally comprise the major amount of the composition. Thus it will normally be at least 50% by weight of the composition, preferably 85 to 99.95%, and more preferably 92 to 99.9%. The active component of the lubricant system (the thiocarbamate), in turn will normally comprise at least 10 parts per million of the composition, preferably 0.1 to 3 weight percent of the composition. As an alternative embodiment, however, the present invention can provide an additive concentrate in which the oil can be present in a lower amount, e.g. 0 to 20% by weight, preferably about 1 to 10%, and the other components, described in more detail below, are proportionately increased.

The carrier fluid will ordinarily be such an oil when the lubricating composition is supplied from a sump, as in a sump-lubricated internal combustion engine. On the other hand, the carrier fluid will more commonly be a liquid fuel when it is desired to conduct the lubrication process of the present invention by a process akin to that used for lubricating a two-stroke engine characteristic of certain diesel engines. In this case the active ingredient of the present invention can be dissolved or dispersed directly in the fuel composition, or it can be added as a concentrate in oil (as described above) or in another medium which is compatible with the liquid fuel.

Suitable liquid fuels include gasoline, (including leaded and unleaded grades), oxygenated grades of gasoline including alcohol-containing gasolines, where the alcohol can be methanol, ethanol, or a mixture of lower alkanols, and other distillates of petroleum or other natural or synthetic fuel sources, including diesel fuels, jet fuel, kerosine, fuel oil, and also including such fuels as compressed gas fuel or liquified natural gas. When the carrier fluid is a fuel, the active component (the thiocarbamate) comprises at least 10 parts per million of the composition, and preferably 10 to 5000 parts per million of the composition.

Alternatively, the carrier fluid can be or can contain water. It can also be a refrigerant fluid. The term refrigerant fluid is intended to include gases or volatile liquids which can be readily converted between the liquid and gas states, to serve as a heat transfer means in a refrigerator, air conditioner, or heat pump unit. Refrigerant fluids include one or more halocarbon, carbon dioxide, and ammonia. The compounds of the present invention can be used to provide lubrication to refrigeration or heat transfer components.

The other major component of the present invention is a thiocarbamate compound, preferably a dithiocarbamate compound, and more preferably a dithiocarbamate salt.

The thiocarbamates used in making the thiocarbamate-containing compound are prepared by a well-known process, e.g. by reacting an amine with carbon disulfide or carbonyl sulfide, according to the reaction $$R^1R^2NH + CS_2 \rightarrow [R^1R^2NCSSH] \quad (I)$$

When the reaction is with $CS_2$, the product is a dithiocarbamic acid, as shown. When the reaction is with COS, the product is thiocarbamic acid, which can have the formula $$R^1R^2NCOSH \quad (I')$$

As used herein, the terms "thiocarbamic" or "thiocarbamate" are intended to include dithiocarbamic or dithiocarbamate, unless otherwise specified. The thiocarbamic acid is generally not isolated, but is further reacted to form the thiocarbamate of the present invention. The thiocarbamic acid can be reacted with a metal source to yield a metal thiocarbamate:

$$[R^1R^2NCSSH] + M_nX_o \rightarrow (R^1R^2CSS)_pM_q \quad (II)$$

(only the dithiocarbamate being here shown) where M is a metal or metal complex, X is a counter ion, and n, o, p, and q are numbers suitable to satisfy the valences of the chemical species. $M_nX_o$ can be a metal oxide or hydroxide. Where M is a metal complex, a suitable metal thiocarbamate can be expressed generally by the formula $$(R^1R^2NCSS)_{p[Me_bO_cS_d]_a} \quad (II')$$

(only the dithiocarbamate being here shown) where Me is the metal, b is at least 1, a is at least 1, depending on the oxidation state of Me, c is at least 1 depending on the oxidation state of Me, and d is 0 or at least 1 depending on the oxidation state of Me. Generally a and b will be 1 to 5, c will be from 1 to 6, and d will be 0 to 10. In a preferred embodiment a will be 1 or 2, b will be 1 or 2, c will be 1 or 2, and d will be 0 or 2.

The metal can be any known metal and is preferably one or more alkali, alkaline earth, or transition metals from groups 3*b*, 4*b*, 5*b*, 6*b*, 7*b*, 8, 1*b* and 2*b* (CAS notation) of the periodic table of elements, including copper, cobalt, nickel, tungsten, titanium, manganese, molybdenum, iron, chromium, and vanadium, and also including the lanthanides (rare earth elements). The more preferred compounds are compounds of molybdenum. Molybdenum dithiocarbamates are generally believed to be complex salts having one or more structures such as (III)

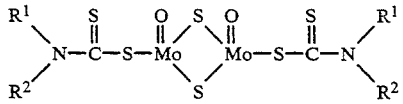

(III)

although the scope of the present invention is not intended to be limited thereby. Such molybdenum thiocarbamates have been described in more detail in U.S. Pat. No. 4,846,983.

Molybdenum dithiocarbamates can be prepared by reacting carbon disulfide with a secondary amine at a temperature of 80° C. or above in an aqueous medium containing a molybdenum compound selected from the group consisting of molybdenum trioxide, alkaline metal molybdates, ammonium molybdate, and their mixtures, and containing a sulfide compound selected from the group consisting of an alkaline metal hydrogen sulfide, ammonium hydrogen sulfide, and alkaline metal sulfide, ammonium sulfide, and their mixtures, in the molar ratio of molybdenum compound to sulfide compound in the range between 1:0.05 and 1:4. The synthesis of such materials is set forth in more detail in U.S. Pat. Nos. 4,098,705 and 3,356,702.

In formulas (I), (I'), (II), (II'), and (III), each $R^1$ and $R^2$ is independently a hydrogen or a hydrocarbyl group having from 1 to 50 carbon atoms, preferably 3 to 24, more preferably 8 to 24, and still more preferably 12 to 18 carbon atoms; but $R^1$ and $R^2$ should not both be hydrogen. In one embodiment the hydrocarbyl group contains at least 16, e.g., 18 to about 50, carbon atoms. The hydrocarbyl group can also contain substituents or heteroatoms such as O, N, or S; specifically amine-substituted hydrocarbyl groups are contemplated. If amine-substituted hydrocarbyl groups are used, such amino group or groups can themselves interact chemically with carbon disulfide or carbonyl sulfide during the synthesis of the thiocarbamate to form more complex structures. Alternatively, $R^1$ taken together with $R^2$ and the nitrogen atom can form a five, six or seven member heterocyclic group. The above description encompasses all stereo arrangements the $R^1$ and $R^2$groups, including straight and branched groups.

When $R^1$ and $R^2$ are taken together with a nitrogen atom to form a five, six or seven member heterocyclic group, the heterocyclic group is a pyrrolidinyl, a piperidinyl, a morpholinyl or a piperazinyl group. The heterocyclic group may contain one or more, preferably one to three alkyl substituents on the heterocyclic ring. The alkyl substituents preferably contain from about one to about six carbon atoms. Examples of heterocyclic groups include 2-methylmorpholinyl, 3-methyl-5-ethylpiperidinyl, 3-hexylmorpholinyl, tetramethylpyrrolidinyl, piperazinyl, 2,5-dipropylpiperazinyl, piperidinyl, 2-butylpiperazinyl, 3,4,5-triethylpiperidinyl, 3-hexylpyrrolidinyl, and 3-ethyl-5-isopropylmorpholinyl groups. Preferably, the heterocyclic group is a pyrrolidinyl or piperidinyl group. In another embodiment, one $R^1$ and $R^2$ in (III) taken together with a nitrogen atom form a five, six or seven member heterocyclic group while the other $R^1$ is independently a hydrogen or a hydrocarbyl group and the other $R^2$ is a hydrocarbyl group. In another embodiment, each $R^1$ and $R^2$ in (III) taken together with the nitrogen atom form a five, six or seven member heterocyclic group.

The amines may be primary or secondary amines. Aliphatic amines are preferred. Specific secondary aliphatic amines include dimethylamine, diethylamine, and preferably dipropylamine, dibutylamine, diamylamine, dihexylamine, diheptylamine, dicocoalkylamine, ditallowamine, dihydrogenated tallowalkylamine, didecylamine, and dioctadecylamine. Nonsymmetrical secondary amines may also be used, including methylethylamine, ethylbutylamine, ethylamylamine and the like. Primary aliphatic amines, which are preferred, include hexylamine, heptylamine, octylamine, 2-ethylhexylamine, nonylamine, decylamine, undecylamine, dodecylamine, octadecylamine, oleylamine, cocoalkylamine, soyaalkylamine, tallowalkylamine, and hydrogenated tallowalkylamine. Polyamines can also be used, including N-coco-1,3-diaminopropane, N-tallow-1,3-diaminopropane, N-oleyl-1,3-diaminopropane, and N-tallowalkyl dipropylene triamine. Likewise amines containing other heteroatoms can be used, including ether amines such as methoxypropylamine, ethoxypropylamine, isopropoxypropylamine, n-hexyloxypropylamine, isooctyloxypropylamine, $C_{12}$–$C_{14}$ oxypropylamine, $C_{14}$–$C_{16}$ oxypropylamine, tridecyloxypropylamine, and methoxyethoxypropylamine. Mixtures of amines can be used.

The thiocarbamate compounds may also be thiocarbamate esters, thiocarbamate amides, thiocarbamic ethers, or alkylene-coupled thiocarbamates, or, preferably, mixtures of such compounds with the above-described thiocarbamate salts. The thiocarbamate amides, ether, and esters are generally prepared by reacting a thiocarbamic acid, prepared as above, with an unsaturated amide, ether, or ester to form the thiocarbamate-containing compounds according to the following reaction:

$$[R^1R^2NCSSH]+R^3CH{=}CHY \rightarrow R^1R^2CSSR^3CHCH_2Y \quad \text{(IV)}$$

(or the corresponding reaction with the monothiocarbamic acid) where $R^3$ is hydrogen or a hydrocarbyl group and Y is a group to form an amide, ether, or ester, i.e., —$CONR^4R^5$, —$CH_2OR^6$, or —$COOR^7$, respectively, where $R^4$, $R^5$, and $R^6$ are hydrogen or hydrocarbyl and $R^7$ is hydrocarbyl. The unsaturated amides, ethers, or esters which are reacted with the thiocarbamic acid are preferably alpha, beta unsaturated compounds. Preferably, these compounds include methyl acrylate, ethyl acrylate, 2-ethylhexyl acrylate, 2-hydroxyethylacrylate, ethylmethacrylate, 2-hydroxyethyl methacrylate, 2-hydroxypropylmethacrylate, 2-hydroxypropyl acrylate, an acrylamide, and acrylonitrile, preferably acrylamides. Acrylamides include acrylamide, methacrylamide, bisacrylamide, bismethacrylamide, bismethyleneacrylamide, N-hydroxymethylacrylamide, and N-mercaptomethylacrylamide.

The thiocarbamates are reacted with the unsaturated compounds at a temperature of 25° C. to 125° C., preferably 50° C. to 100° C., more preferably 70° C. to 90° C. The reaction may be carried out in the presence or absence of a solvent. Solvents include hydrocarbons such as toluene, xylene, hexane, heptane, kerosene, fuel oil or oils of lubricating viscosity as well as chlorohydrocarbons including chloroform, carbon tetrachloride and the like. Alcohols may also be used, such as methanol, ethanol, propanol, butanol, 2-ethylhexanol and the like.

In another embodiment, the thiocarbamate-containing compound is an alkylene-coupled thiocarbamate. Alkylene-coupled dithiocarbamates may be represented by the formula $$R^1R^2N-\overset{\overset{\displaystyle S}{\|}}{C}-S-R^9-S-\overset{\overset{\displaystyle S}{\|}}{C}-NR^1R^2 \quad \text{(V)}$$

wherein $R^1$ and $R^2$ are defined as above and $R^9$ is a hydrocarbylene group having from 1 to about 10 carbon atoms, preferably 1 to about 4, more preferably 1 or 2. Preferably, $R^9$ is an alkylene, arylene, alkarylene, or arylalkylene. In one embodiment, $R^9$ is an alkylene group, preferably, a methylene or ethylene group, more preferably methylene.

In one embodiment, $R^9$ is an arylene group, alkarylene group, or arylalkylene group having from 6 to about 10 carbon atoms, preferably 6 to about 8. Preferably, $R^9$ is a phenylmethylene, phenylethylene, phenyldiethylene, phenylene, tolylene, etc.

Preferably the thiocarbamate compound is a dithiocarbamate compound, more preferably a molybdenum dialkyldithiocarbamate, and still more preferably a molybdenum monoalkyldithiocarbamate. The alkyl groups can contain at least 1 to 50 carbon atoms, preferably 3 to 24, more preferably 8 to 24, and still more preferably 12 to 18 carbon atoms, including both branched and straight-chain groups. More generally they can have the compositions defined above for groups $R^1$ and R2. An example of a preferred alkyl group is oleyl, and a preferred compound is molybdenum N-oleyl dithiocarbamate.

The lubricating composition used in the present invention may, and ordinarily will, contain other additives which are known in the field of lubricants. Such additives include antioxidants, corrosion inhibitors, extreme pressure and anti-wear agents including chlorinated aliphatic hydrocarbons and boron-containing compounds including borate esters, viscosity improvers and multi-functional viscosity improvers, pour point depressants, and anti-foam agents. Especially preferred additional additives include overbased salts and dispersants.

Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Dispersants are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include N-substituted long chain alkenyl succinimides, having a variety of chemical structures including typically

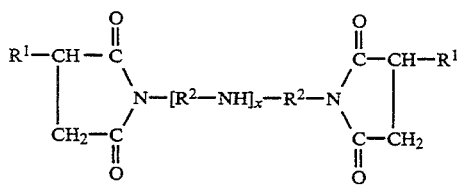

where each $R^1$ is independently an alkyl group, frequently a polyisobutyl group with a molecular weight of 500–5000, and $R^2$ are alkenyl groups, commonly ethylenyl ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. No. 4,234,435.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

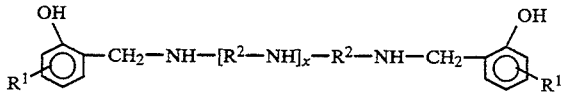

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

The lubricating composition described above is used to lubricate the interface between a metal part and a ceramic part. This interface will typically be the point of contact between two pieces in a partially ceramic engine. Among the many parts in an engine which may be made of ceramic are tappets, camshafts, rocker arms, oil pump gears, pistons, piston rings, piston pins, cylinder liners, bearings, and turbocharger parts. The lubricant will typically be supplied from a sump by means of a pump (as in a traditional sump-lubricated spark-ignited gasoline engine), although other means can be used (as in a two-cycle compression-ignited diesel engine). If the lubricating composition is supplied from a sump, it is preferred that the sump temperature not exceed 175° C., and more preferably 150° C. in order to avoid thermal degradation of the lubricant. Likewise the temperature of the parts to be lubricated are preferably similarly limited, in order to avoid thermal degradation of the lubricant. On the other hand, the temperature of the surfaces which are to be lubricated by the present process should preferably be at least 50° C., since it has been observed that at such moderately elevated temperatures molybdenum dithiocarbamate has been observed to form a $MoS_2$ film on the contact surfaces. Formation of such a film is believed to be important in the effective lubrication of the present process, but the present invention is not intended to be limited by any such theoretical mechanism.

As used herein, the term "hydrocarbyl substituent" or "hydrocarbyl group" means a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms.

EXAMPLES

Examples 1–6.

Wear testing is measured using a reciprocating wear tester which has a pin-on-plate type of contact geometry of a type commonly used for such testing purposes. Such an apparatus has been described in "Evaluation of High Temperature Lubricants in Ceramic/Metal and Metal/Metal Contacts," STLE [Society of Tribologists and Lubrication Engineers]Preprint No. 92-TC-4A-4 (1992). Silicon nitride is used as a plate specimen and cast iron as a pin specimen. Plates are 76 mm (3 inches) in length, 25 mm (1 inch) in width, and 6 mm (0.25 inches) in thickness.

Wear testing is conducted at bulk specimen temperature of room temperature to 200° C. (typically 150° C.) for two hours at an average sliding speed of 0.05 m/sec. Wear tested specimens are analyzed by scanning electron microscopy, energy dispersive analysis of X-rays ("EDAX"), Auger electron spectroscopy, and X-ray photoelectron spectroscopy.

The lubricating formulations are prepared using Exxon oil as a base oil, to which is added molybdenum N-oleyl-dithiocarbamate ("MoDTC") and optionally overbased synthetic calcium alkylsulfonate (390 number average molecular weight), overbased with calcium carbonate to a total base number of 300, metal ratio 14:1, and further containing 5% by weight polyisobutylene (940 number average molecular weight) substituted succinic anhydride (together referred to as "detergent"), and optionally also the reaction product of polyisobutylene (number average molecular weight 2000) substituted succinic anhydride with polyethylene polyamine (having an average composition corresponding to pentaethyleneamine) (referred to as "dispersant") as indicated in Table I:

TABLE I

| Ex. | MoDTC (wt. %) | Detergent (wt. %) | Dispersant (wt. %) | ZDP (wt. %) | Oil[a] |
|---|---|---|---|---|---|
| 1* | 0 | 0 | 0 | 0 | 100 |
| 2 | 1.0 | 0 | 0 | 0 | balance |
| 3* | 0 | 0 | 0 | 0.9 | " |
| 4 | 1.0 | 0.47 | 0 | 0 | " |
| 5 | 1.0 | 0 | 1.8 | 0 | " |
| 6 | 1.0 | 0.47 | 1.8 | 0 | " |

*comparative examples
[a]total of base oil and diluent oil, if any, present in the other components as received.

Each of the compositions of Examples 1–6 is tested as described above. Tests using the lubricants of Examples 2, 4, 5, and 6 exhibit very low total wear volume, as does comparative Example 3, in each case being significantly better than the control, comparative Example 1. But for the examples of the present invention, the improvement is observed even in the presence of detergent and dispersant The wear volumes measured compare favorably with the results when the test is repeated using two cast iron surfaces. This is particularly significant in view of the fact that the contact stress on cast iron, when tested against silicon nitride, is 20% greater than when cast iron is tested against cast iron, since the silicon nitride does not significantly deform under pressure.

Examples 7–37

The test of Example 6 is repeated except that the dithiocarbamate is replaced with the amount and identity of material indicated in Table II:

TABLE II

| Ex. | Carbamate component, wt. % |
|---|---|
| 7 | MoDTC of Ex. 2, 3 |
| 8 | MoDTC of Ex. 2, 0.1 |
| 9 | molybdenum N,N-di-2-ethylhexyl-dithiocarbamate, 1 |
| 10 | molybdenum N-2-ethylhexyl-dithiocarbamate, 1 |
| 11 | molybdenum N,N-di-dodecyl-dithiocarbamate, 1 |
| 12 | molybdenum N-2-ethylhexyl,N-isopropyl-dithiocarbamate, 1 |
| 13 | copper N,N-di-2-ethylhexyl-dithiocarbamate, 1 |
| 14 | tin N,N-di-2-ethylhexyl-dithiocarbamate, 1 |
| 15 | antimony N,N-di-2-ethylhexyl-dithiocarbamate, 1 |
| 16 | cerium N,N-di-2-ethylhexyl-dithiocarbamate, 1 |
| 17 | sodium N,N-di-2-ethylhexyl-dithiocarbamate, 1 |
| 18 | potassium N,N-di-2-ethylhexyl-dithiocarbamate, 1 |
| 19 | magnesium N,N-di-2-ethylhexyl-dithiocarbamate, 1 |
| 20 | calcium N,N-di-2-ethylhexyl-dithiocarbamate, 1 |
| 21 | barium N,N-di-2-ethylhexyl-dithiocarbamate, 1 |
| 22 | copper N,N-di-2-ethylhexyl-dithiocarbamate, 1 |
| 23 | nickel N,N-di-2-ethylhexyl-dithiocarbamate, 1 |
| 24 | tungsten N,N-di-2-ethylhexyl-dithiocarbamate, 1 |
| 25 | titanium N,N-di-2-ethylhexyl-dithiocarbamate, 1 |
| 26 | manganese N,N-di-2-ethylhexyl-dithiocarbamate, 1 |
| 27 | iron N,N-di-2-ethylhexyl-dithiocarbamate, 1 |
| 28 | chromium N,N-di-2-ethylhexyl-dithiocarbamate, 1 |
| 29 | vanadium N,N-di-2-ethylhexyl-dithiocarbamate, 1 |
| 30 | zinc N,N-di-2-ethylhexyl-dithiocarbamate, 1 |
| 31 | molybdenum N-dodecyl-dithiocarbamate, 1 |
| 32 | molybdenum N-octadecyl-dithiocarbamate, 1 |
| 33 | molybdenum N-cocoalkyl-dithiocarbamate, 1 |
| 34 | molybdenum salt of reaction product of n-tallow-1,3-diaminopropane with carbon disulfide, 1 |
| 35 | molybdenum N-oleyl-thiocarbamate (as distinct from the dithiocarbamate), 1 |

TABLE II-continued

| Ex. | Carbamate component, wt. % |
|---|---|
| 36 | dithiocarbamate ester prepared by reaction of di-2-ethylhexylamine with carbon disulfide and ethyl acrylate, 1 |
| 37 | dithiocarbamate amide prepared by reaction of di-butylamine with carbon disulfide and N-methyl acrylamide, 1 |

Examples 38–40

Compositions are prepared of dithiocarbamates in liquid fuels, as indicated in Table III:

TABLE III

| Example | Fuel | Dithiocarbamate, wt. % |
|---|---|---|
| 38 | gasoline | MoDTC of Ex. 2, 0.5 |
| 39 | kerosene | Zn compound of Ex. 19, 0.001 |
| 40 | 90:10 gasoline-ethanol mixture | MoDTC of Ex. 2, 0.1 |

Each of the documents referred to above is incorporated herein by reference. Except in the Examples, or where otherwise explicitly indicated, all numerical quantities in this description specifying amounts of materials or reaction conditions are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. As used herein, the expression "consisting essentially of" permits the inclusion of substances which do not materially affect the basic and novel characteristics of the composition under consideration.

What is claimed is:

1. A method for lubricating a metal-ceramic interface, comprising supplying to said interface a composition comprising:

(a) a carrier fluid, and (b) a copper, cobalt, nickel, tungsten, titanium, manganese, molybdenum, iron, chromium, vanadium, or rare earth element thiocarbamate compound in an amount suitable to impart improved wear performance to said interface.

2. The method of claim 1 wherein the composition is supplied from a sump at a sump temperature of up to about 175° C.

3. The method of claim 1 wherein the composition is supplied to the interface by a pump.

4. The method of claim 1 wherein the metal of the metal-ceramic interface comprises iron.

5. The method of claim 1 wherein the ceramic of the metal-ceramic interface comprises silicon nitride.

6. The method of claim 1 wherein the metal-ceramic interface is a part of an internal combustion engine.

7. The method of claim 6 wherein the internal combustion engine is a spark-ignited engine.

8. The method of claim 6 wherein the internal combustion engine is a compression-ignition engine.

9. The method of claim 1 wherein the thiocarbamate compound comprises at least about 10 parts per million of the composition.

10. The method of claim 1 wherein the carrier fluid is a fuel.

11. The method of claim 10 wherein the fuel is gasoline, diesel fuel, jet fuel, an alcohol-containing fuel, or a compressed gas fuel.

12. The method of claim 10 wherein the thiocarbamate compound comprises about 10 parts to about 5000 parts per million parts by weight of the fuel.

13. The method of claim 1 wherein the carrier fluid comprises water.

14. The method of claim 1 wherein the carrier fluid is a refrigeration fluid.

15. The method of claim 1 wherein the carrier fluid is an oil of lubricating viscosity.

16. The method of claim 15 wherein the oil of lubricating viscosity is selected from the group consisting of natural and synthetic lubricating oils.

17. The method of claim 15 wherein the oil is mineral oil.

18. The method of claim 15 wherein the thiocarbamate compound comprises about 0.1 to about 3 weight percent of the, composition.

19. The method of claim 1 wherein the thiocarbamate compound is an ester.

20. The method of claim 1 wherein the thiocarbamate compound is a metal salt.

21. The method of claim 20 wherein the metal is molybdenum.

22. The method of claim 21 wherein the molybdenum thiocarbamate is a molybdenum hydrocarbylthiocarbamate.

23. The method of claim 22 wherein the molybdenum hydrocarbylthiocarbamate is a molybdenum alkythiocarbamate.

24. The method of claim 23 wherein the molybdenum alkylthiocarbamate is a molybdenum alkyldithiocarbamate.

25. The method of claim 24 wherein the molybdenum alkyldithiocarbamate is molybdenum N-oleyl dithiocarbamate.

26. The method of claim 1 wherein the composition further comprises an overbased metal salt.

27. The method of claim 1 wherein the composition further comprises a dispersant.

28. An internal combustion engine containing a metal-ceramic interface lubricated by the method of claim 1.

29. A method for lubricating a metal-ceramic interface, comprising supplying to said interface a composition comprising:

(a) a carrier fluid, and (b) an N-hydrocarbyl thiocarbamate compound in an amount suitable to impart improved wear performance to said interface, where the hydrocarbyl substituent-contains at least 16 carbon atoms.

30. The method of claim 29 wherein the hydrocarbyl substituent contains 18 to about 50 carbon atoms.

31. An internal combustion engine containing a metal-ceramic interface lubricated by the method of claim 29.

* * * * *